US005754934A

United States Patent [19]

Kamezaki et al.

[11] Patent Number: 5,754,934

[45] Date of Patent: May 19, 1998

[54] RECIRCULATING DOCUMENT FEEDER

[75] Inventors: Yasushi Kamezaki; Tsuyoshi Nagao; Masayuki Kakuta, all of Osaka, Japan

[73] Assignee: Mita Industrial Company, Ltd., Osaka, Japan

[21] Appl. No.: 736,080

[22] Filed: Oct. 24, 1996

[30] Foreign Application Priority Data

Oct. 27, 1995 [JP] Japan ..... 7-280500

[51] Int. Cl.[6] ..... G03G 15/00

[52] U.S. Cl. ..... 399/373; 271/3.05; 271/225; 399/374

[58] Field of Search ..... 399/373, 374, 399/367; 271/3.01, 3.05, 8.1, 225

[56] References Cited

U.S. PATENT DOCUMENTS

| | | | |
|---|---|---|---|
| 4,456,236 | 6/1984 | Buddendeck | 271/3.05 |
| 4,566,782 | 1/1986 | Britt et al. | 399/374 |
| 5,122,840 | 6/1992 | Maeyama | 399/374 |
| 5,515,150 | 5/1996 | Yoshie et al. | 399/367 |

FOREIGN PATENT DOCUMENTS 61-80144 4/1986 Japan .

*Primary Examiner*—Arthur T. Grimley
*Assistant Examiner*—Sophia S. Chen
*Attorney, Agent, or Firm*—Antonelli, Terry, Stout, & Kraus, LLP

[57] ABSTRACT

A recirculating document feeder for use with an image forming machine having a transparent platen. This recirculating document feeder includes a document support disposed above the transparent platen and adapted to have a stack of documents placed thereon, with a selected side of each document facing down; a feed-out path extending from one end of the document support; a first switchback path having an upstream end connected to the downstream end of the feed-out path; a send-in path extending from its upstream end, which is connected to the upstream end of the first switchback path, to one end of the transparent platen; a send-out path extending from the other end of the transparent platen; a second switchback path having an upstream end connected to the downstream end of the send-out path; and a return path extending from its upstream end, which is connected to the upstream end of the second switchback path, to the other end of the document support. The bottom-most document of the document stack placed on the document support is fed out to the feed-out path, fed to the first switchback path through the feed-out path, and then sent onto the transparent platen through the send-in path in a reversed direction of feeding. Then, the document is fed from the transparent platen to the second switchback path through the send-out path, and then returned onto the document stack on the document support through the return path after the direction of its feeding is reversed again.

1 Claim, 8 Drawing Sheets

RECIRCULATING DOCUMENT FEEDER

FIELD OF THE INVENTION

The present invention relates to a recirculating document feeder for use with an image forming machine, such as a copying apparatus, a printing machine or a facsimile machine, which has a transparent platen.

DESCRIPTION OF THE PRIOR ART

U.S. Pat. No. 4,169,674 discloses a recirculating document feeder for use with an image forming machine having a transparent platen. Such a recirculating document feeder includes a document support means disposed above the transparent platen of the image forming machine, a send-in path extending in a laterally laid U-shape between one end of the document support means and one end of the transparent platen, a send-out path extending in a laterally laid U-shape between the other end of the transparent platen and the other end of the document support means, and a document feed means. Documents are stacked in a required order and placed on the document support means with the selected side of each document facing up. In a stack of the documents placed on the document support means, therefore, the first document is located at the top-most position. The document feed means feeds the bottom-most document of the document stack placed on the document support means out into the send-in path, and sends it onto the transparent platen through the send-in path (accordingly, inverting the face and back of the document). Hence, when sent onto the transparent platen, the document has its selected side (i.e. the surface to be copied or read) facing downwardly. After scan exposure or scan reading of the selected side of the document is completed in the image forming machine, the document feed means returns the document on the transparent platen onto the document stack on the document support means through the send-out path (accordingly, reinverting the face and back of the document to restore the document to the original state, i.e., the selected side facing upwardly). Such document feed is performed repeatedly, the number of times corresponding to the number of the documents, whereby a set of the documents is copied or read.

The above-described recirculating document feeder poses the following problem, because it feeds the bottom-most document of the stack of documents stacked with their selected sides facing up; in other words, it delivers the documents, placed on the document support means, in succession onto the transparent platen, starting with the final document and ending with the first document: Assume that the documents are so-called one-side documents, each having an image formed on the selected side only, but the resulting copy or print is to have this image on both sides. In this case, prior to scan exposure or scan reading of the documents, it is necessary to feed the documents in succession, count the number of the documents, and determine whether the number of the documents is an odd number or an even number. If the number of the documents is an odd number, the first copy or print will have no image on its back, but have only on its face an image corresponding to the image on the selected side of the bottom-most document or the final document of the document stack. Subsequent copies or prints will each have the image formed on the back and face thereof in succession. If the first copy or print has the image formed on its back and face although the number of the documents is an odd number, the disadvantage will arise that the last copy or print will have no image on its face, and the back of the last copy or print will have an image corresponding to the image of the first document. The above-mentioned operation for counting the number of documents prolongs the time required for an image forming/processing operation, and additionally delivers all documents in succession prior to scan exposure or scan reading of the documents. This increases the probability of a document jam or document damage.

Japanese Patent Publication No. 103407/1994 also discloses a recirculating document feeder for use with an image forming machine having a transparent platen. This recirculating document feeder includes a document support means disposed above the transparent platen of the image forming machine, an additional feed path extending between the document support means and the transparent platen, a feed-out path extending in a laterally laid U-shape between one end of the document support means and one end of the additional feed path, a send-in path extending in a laterally laid U-shape between the downstream end of the additional feed path and one end of the transparent platen (the end located on the side opposite to the one end of the document support means), a send-out path extending from the other end of the transparent platen, a switchback path having an upstream end connected to the downstream end of the send-out path, a return path extending from its upstream end connected to the upstream end of the switchback path to the one end of the document support means, and a document feed means. Documents are stacked in a required order, and placed on the document support means with the selected side of each document facing down. In a stack of the documents placed on the document support means, therefore, the first document is located at the bottom-most position. The document feed means conveys the bottom-most document of the document stack placed on the document support means into the additional feed path through the send-out path (accordingly, inverting the face and back of the document), and then delivers it onto the transparent platen through the send-in path (accordingly, reinverting the document to restore it to the original state). Hence, when delivered onto the transparent platen, the document has its selected side facing downwardly. After scan exposure or scan reading of the selected side of the document is completed in the image forming machine, the document feed means sends the document on the transparent platen out to the switchback path through the send-out path. The document sent out to the switchback path is headed in a reversed direction of feeding, and returned onto the document stack on the document support means through the return path.

Such a recirculating document feeder feeds the bottom-most document of the stack of documents stacked with their selected sides facing down. In other words, the documents placed on the document support means are delivered in succession onto the transparent platen, starting with the first document and ending with the final document. Thus, this type of recirculating document feeder is free from the problem involved in the aforementioned recirculating document feeder. However, during feeding of the document from the document support means onto the transparent platen, the document is fed through the additional feed path disposed between the document support means and the transparent platen. Thus, even when the length of the document in the direction of its feeding is relatively short, the document needs to be conveyed over a considerable distance until its feeding onto the transparent platen. This poses the problem of taking a considerable time for document feeding. Also, there is a high probability of a document jam, because the required length of feeding is large.

SUMMARY OF THE INVENTION

A principal object of the present invention is to provide a novel and improved recirculating document feeder of the type in which the document stack is placed on the document support means with the selected side of each document facing down, and the bottom-most document of this document stack is fed out (hence, even if the documents are one-side documents each having an image formed on the selected side only, but the images are to be formed on both sides of copies or prints, there is no need to count the number of the documents prior to scan exposure or scan reading); however, particularly when the length of the document in the direction of its feeding is relatively small, the distance of document feeding from the document support means to the transparent platen can be made markedly shorter than that of a conventional document feeder.

Another object of the present invention is to provide a novel and improved recirculating document feeder in which when images are formed on both sides of the document, the document fed onto the transparent platen with its one side facing down can be sent out from the transparent platen, whereafter the face and back of the document can be inverted, and the document can be fed again onto the transparent platen with the other side of the document facing down.

To attain the principal object, the present invention provides a recirculating document feeder for use with an image forming machine having a transparent platen, the feeder comprising:

a document support means disposed above the transparent platen and adapted to have a stack of documents placed thereon with the selected side of each document facing down;

a feed-out path extending from one end of the document support means;

a first switchback path having an upstream end connected to the downstream end of the feed-out path;

a send-in path extending from its upstream end, which is connected to the upstream end of the first switchback path, to one end of the transparent platen;

a send-out path extending from the other end of the transparent platen;

a second switchback path having an upstream end connected to the downstream end of the send-out path;

a return path extending from its upstream end, which is connected to the upstream end of the second switchback path, to the other end of the document support means; and a document feed means which feeds the bottom-most document of the document stack placed on the document support means out to the feed-out path, feeds this document to the first switchback path through the feed-out path, then sends the document fed to the first switchback path onto the transparent platen through the send-in path after reversing the direction of feeding of the document, then feeds the document from the transparent platen to the second switchback path through the send-out path, and then returns the document sent into the second switchback path onto the document stack on the document support means through the return path after again reversing the direction of feeding of the document.

To attain the other object, a resend-in path extending between an intermediate portion of the return path and the other end of the transparent platen is provided;

a downstream portion of the second switchback path and a downstream portion of the return path are merged; and the document feed means selectively feeds the document on the transparent platen to the second switchback path through the send-out path, then feeds the document sent into the second switchback path to the downstream portion of the return path after again reversing the direction of feeding of the document, then resends the document onto the transparent platen through the resend-in path after further reversing the direction of feeding of the document, and further returns the document from the transparent platen onto the document stack on the document support means through the second switchback path.

DETAILED DESCRIPTION OF THE PREFERRED EMBODIMENTS

Figure 1:
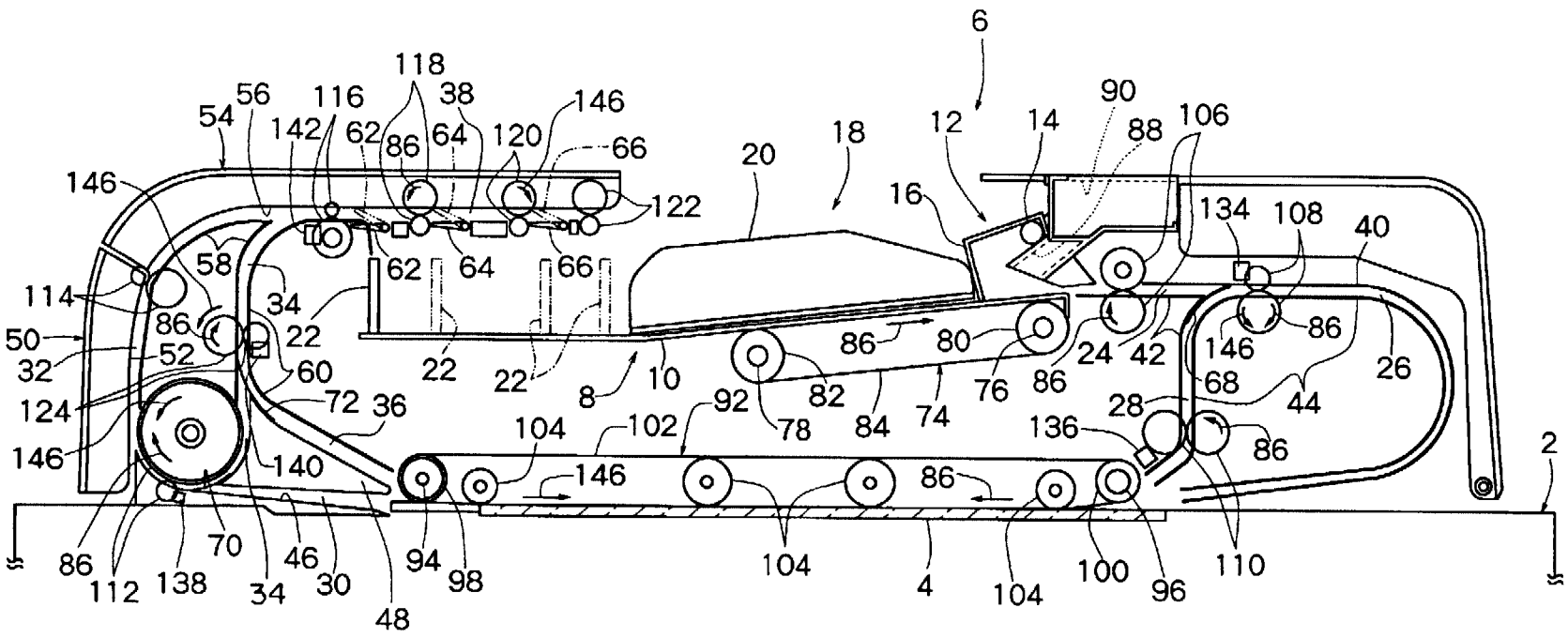
FIG. 1 is a sectional view illustrating a preferred embodiment of a document feeder constructed in accordance with the present invention.

The present invention will now be described in detail by reference to the accompanying drawings showing preferred embodiments of a recirculating document feeder constructed in accordance with the present invention.

An image forming machine, such as an electrostatic copying apparatus, has a housing 2 (only its upper with portion is shown), and a transparent platen 4 of glass extending substantially horizontally on the top of the housing 2. A recirculating document feeder constructed in accordance with the present invention, entirely designated by the numeral 6, is disposed on the housing 2 of the image forming machine. Such a document feeder 6 is mounted on the housing 2 so as to be pivotable, about a pivot axis extending along the rear edge of the transparent platen 4, between a closed position for covering the transparent platen 4 (the position illustrated in FIG. 1) and an open position for exposing the transparent platen 4.

A document support means 8 positioned above the transparent platen 4 is disposed in the document feeder 6. The document support means 8 includes a document support plate 10, and when the document feeder 6 is positioned at the illustrated closed position, the document support plate 10 extends nearly parallel to the transparent platen 4 with an upward spacing from the transparent platen 4. In more detail, a downstream half of the document support plate 10 (the left half in FIG. 1) extends substantially parallel (accordingly, substantially horizontally) to the transparent platen 4, while an upstream half of the document support plate 10 (the right half in FIG. 1) extends upwardly slightly inclinedly toward the right. At an upstream end portion of the document support plate 10, a front end regulating means 12 is disposed. The front end regulating means 12 has a rotating shaft 14 extending in the back-and-forth direction (the direction perpendicular to the sheet face in FIG. 1), and a regulating member 16 of an L-shaped cross section fixed to the rotating shaft 14. By the action of an actuating means (not shown), such as a solenoid, connected to the rotating shaft 14 via a suitable connecting mechanism, the regulating member 16 is selectively brought to a lowered position where its lower edge contacts the top surface of the document support plate 10, and a raised position where the regulating member 16 is slightly raised from the descent position and its lower end is separated from the top surface of the document support plate 10 by a slight distance (e.g. about 0.5 to 2.0 mm). A width regulating means 18 is also disposed in the document support means 8. This width regulating means 18 includes a stationary regulating member (not shown) disposed at the rear end of the document support plate 10, and a movable regulating member 20 disposed at a front part of the document support plate 10. The movable regulating member 20 is mounted so as to be movable back and forth, and it is manually moved back and forth depending on the width of a document to be placed on the document support plate 10. By so doing, the spacing between the stationary regulating member and the movable regulating member 20 is made consistent with the width of the document. The stationary regulating member and the movable regulating member 20 are provided with a separating member (not shown) to be selectively brought to an operating position where the separating member protrudes widthwise inwardly. The separating member, as will be further described later, is brought to the operating position after placement of a document stack on the document support plate 10, whereby the separating member protrudes onto the document stack. Documents returned onto the document support plate 10 after being fed from the document stack onto the transparent plate are positioned above the separating member located at the operating position. At the downstream portion of the document support plate 10, a rear end regulating means 22 is disposed. The rear end regulating means 22 is composed of a regulating member disposed so as to be movable in the direction of feeding of the document (the left-to-right direction in FIG. 1). The rear end regulating means 22 is manually moved in the direction of feeding depending on the length in the direction of feeding of the document to be placed on the document support plate 10. By so doing, the spacing between the regulating member 16 of the front end regulating means 12 and the regulating member of the rear end regulating means 22 is made consistent with the length of the document in the direction of its feeding. The above-described construction of the document support means 8 itself is well known to those skilled in the art. Thus, an explanation of the details of the construction of the document support means 8 itself is omitted.

The illustrated document feeder 6 includes various document feed paths disposed between the document support means 8 and the transparent plate 4, i.e., a feed-out path 24, a first switchback path 26, a send-in path 28, a send-out path 30, a second switchback path 32, a return path 34, and a resend-in path 36. Feed-out path 24 extends substantially horizontally from one end of the document support means 8, i.e., its upstream end (the right end in FIG. 17. The first switchback path 26 extends in a laterally laid U-shape from its upstream end connected to the downstream end of the feed-out path 24. The send-in path 28 extends in a nearly S-shape from its upstream end connected to the upstream end of the first switchback path 26 to one end of the transparent platen 4 (the right end in FIG. 1). The send-out path 30 extends nearly horizontally from the other end of the transparent platen 4 (the left end in FIG. 1) to the left. The second switchback path 32 extends in a nearly laterally laid U-shape from its upstream end connected to the downstream end of the send-out path 30 toward the other end of the document support means, i.e., the downstream end (the left end in FIG. 1). The return path 34 extends from its upstream end connected to the upstream end of the second switchback path 32 toward the other end of the document support means 8, i.e., the downstream end. A downstream portion of the second switchback path 32 and a downstream portion of the return path 34 are merged, and the site of merging is defined by a common path 38. The resend-in path 36 extends between an intermediate portion of the return path 34 and the other end of the transparent platen 4.

The outside of the feed-out path 24 and the outside of the first switchback path 26 are defined by a continuously extending guide plate 40. The inside of the feed-out path 24 and the inside of the send-in path 28 are defined by a continuously extending guide plate 42. The inside of the first switchback path 26 and the outside of the send-in path 28 are defined by a continuously extending guide plate 44. The underside or outside of the send-out path 30 is defined by the upper edges of a plurality of plate-like members 46 (only one of them is shown in FIG. 1) disposed with spacing in the width direction (the direction perpendicular to the sheet face in FIG. 1). The inside or upper side of the send-out path 30 is defined by the lower edges of a plurality of plate-like members 48 (only one of them is shown in FIG. 1) disposed with spacing in the width direction. The outside of the upstream portion of the second switchback path 32 is defined by the upper edges of the plate-like members 46 and the inner edges of a plurality of plate-like members 52 (only one of them is shown in FIG. 1) formed with spacing in the width direction on the inner surface of a cover member 50. The outside of the intermediate portion and the downstream portion of the second switchback path 32 is defined by the inner edges of a plurality of plate-like members 56 (only one of them is shown in FIG. 1) formed with spacing in the width direction on the inner surface of a cover member 54. The outside of an upstream portion and an intermediate portion of the return path 34, and the inside of the second switchback path 32 are defined by a continuously extending guide plate 58. The outside of a downstream portion of the return path 34 (accordingly, the common path 38) is defined by the inner edges of the plate-like members 56. The inside of an upstream end portion of the return path 34 is defined by the left edges of the plate-like members 48, and the outside or underside of the resend-in path 36 is defined by the upper edges of the plate-like members 48. The inside or upper side of the resend-in path 36 and the inside of an intermediate portion of the return path 34 are defined by a continuously extending guide plate 60.

On the inside or underside of the common path 38 (accordingly, the downstream portion of the second switchback path 32 and the downstream portion of the return path 34), three switching members 62, 64 and 66 are arranged. Each of the switching members 62, 64 and 66 is equipped with an actuating means, such as a solenoid. When the actuating means are deenergized, the switching members 62, 64 and 66 are each located at a nonoperating position, shown by a solid line in FIG. 1. When the actuating means are energized, the switching members 62, 64 and 66 are each moved to an operating position, shown by a two-dot chain line. As will be further mentioned later, when the switching member 62 is brought to the operating position shown by the two-dot chain line, the document fed to the common path 38 (accordingly, conveyed through the return path 34 or the second switchback path 32) is guided downwardly on the upstream side of the switching member 62 (the left side in FIG. 1) by the guiding action of the switching member 62, and is returned onto the document support plate 10. When the switching member 62 is brought to the nonoperating position shown by the solid line and the switching member 64 is positioned at the operating position shown by the two-dot chain line, the document fed to the common path 38 passes the switching member 62 and is guided downwardly on the upstream side of the switching member 64 by the guiding action of the switching member 64, whereupon the document is returned onto the document support plate 10. When the switching members 62 and 64 are brought to the nonoperating position shown by the solid line and the switching member 66 is positioned at the operating position shown by the two-dot chain line, the document fed to the common path 38 passes the switching members 62 and 64, and is guided downwardly on the upstream side of the switching member 66 by the guiding action of the switching member 66, whereupon the document is returned onto the document support plate 10. When all of the switching members 62, 64 and 66 are brought to the nonoperating position shown by the solid line, the document fed to the common path 38 passes the switching members 62, 64 and 66, and is returned onto the document support plate 10 from the downstream end of the common path 38 (the right end in FIG. 1).

A feed regulating piece 68 is disposed in a region of joining of the downstream end of the feed-out path 24, the upstream end of the first switchback path 26, and the upstream end of the send-in path 28. The feed regulating piece 68 is composed of a flexible member protruding upwardly from its base portion fixed to the guide plate 42 and having a free end portion in contact with the guide plate 40. The document fed through the feed-out path 24 deflects the free end portion of the feed regulating piece 68 righwardly in FIG. 1, and enters the first switchback path 26. As will be further described later, when the direction of feeding of the document conveyed into the first switchback path 26 is reversed, the document is guided by the feed regulating piece 68 and introduced into the send-in path 28.

A second feed regulating piece 70 is disposed in a region of joining of the downstream end of the send-out path 30, the upstream end of the second switchback path 32, and the upstream end of the return path 34. The feed regulating piece 70 is composed of a flexible member protruding downwardly from its base portion fixed to the left edges of the plate-like members 48 and having a free end portion in contact with the upper edges of the plate-like members 46. The document fed through the send-out path 30 deflects the free end portion of the feed regulating piece 70 leftwardly in FIG. 1, and enters the second switchback path 32. As will be further described later, when the direction of feeding of the document conveyed into the second switchback path 32 is reversed, the document is guided by the feed regulating piece 70 and introduced into the return path 34. Furthermore, a feed regulating piece 72 is disposed in a region of joining of the intermediate portion of the return path 34 and the upstream end of the resend-in path 36. The feed regulating piece 72 is composed of a flexible member protruding leftwardly from its base portion fixed to the upper edges of the plate-like members 48 and having a free end portion in contact with the guide plate 58. The document fed through the return path 34 deflects the free end portion of the feed regulating piece 72 upwardly, and enters the downstream portion of the return path 34. As will be further described later, when the direction of feeding of the document conveyed into the downstream portion of the return path 34 is reversed, the document is guided by the feed regulating piece 72 and introduced into the resend-in path 36. The feed regulating pieces 68, 70 and 72 can advantageously be formed of a plastic film such as a polyethylene terephthalate film.

Referring to FIG. 1, a document feed means is also disposed in the document feeder 6. The document feed means includes a document feed-out means 74. The document feed-out means 74 has a driven shaft 76 and a follower shaft 78 mounted rotatably with spacing in the direction of feeding (the left-to-right direction in FIG. 1). To the driven shaft 76, there are fixed a plurality of driven belt pulleys 80 (only one of them is shown in FIG. 1) with spacing in the width direction (the direction perpendicular to the sheet face in FIG. 1). To the follower shaft 78, there are fixed a plurality of follower belt pulleys 82 (only one of them is shown in FIG. 1) in correspondence with the driven belt pulleys 80. An endless belt 84 is wound round each pair of the driven belt pulley 80 and the follower belt pulley 82. An upper travel portion of each of the endless belts 84 is exposed upwardly through an opening formed in the document support plate 10. Furthermore, a multiplicity of suction openings (not shown) are formed in each of the endless belts 84. Such suction openings are made to communicate with a suction source (not shown) via a suction duct (not shown) disposed inwardly of the upper travel portion of the endless belt 84. As will be further mentioned later, when the bottom-most document of the document stack placed on the document support plate 10 is to be fed out to the feed-out path 24, the suction source is emergized, and the endless belt 84 is rotationally driven in the direction of an arrow 86. Thus, the bottom-most document of the document stack is sucked by the upper travel portion of the endless belt 84, moved in the direction of arrow 86, and fed out into the feed-out path 24. An air jet path 88 is disposed above the downstream end of the endless belt 84 (the right end in FIG. 1). The air jet path 88 is made to communicate with a blower (not shown) via a jet duct 90. When the bottom-most document of the document stack is to be fed out, air is jetted toward the front end of the document stack on the document support plate 10, whereby a front end portion of the bottom-most document is separated from the documents placed on it. The document feed-out means 74, and the air jet path 88 provided thereon may be in forms known to those skilled in the art. Therefore, a detailed explanation for their structures is omitted in the present specification.

The document feed means also includes a feed belt mechanism 92 disposed above the transparent platen 4. The feed belt mechanism 92 has a driven shaft 94 and a follower shaft 96 disposed with spacing in the direction of feeding (the left-to-right direction in FIG. 1). A driven belt pulley 98 is fixed to the driven shaft 94, and a follower belt pulley 100 is fixed to the follower shaft 96. An endless belt 102 is wound round the driven belt pulley 98 and the follower belt pulley 100. The feed belt mechanism 92 is further provided with a plurality of pressure rollers 104. These pressure rollers 104 are elastically urged downwardly to press a lower travel portion of the endless belt 102 against the top surface of the transparent platen 4. The document feed means further includes feed roller pairs 106, 108, 110, 112, 114, 116, 118, 120, 122 and 124. The feed belt mechanism 92 and feed roller pairs 106, 108, 110, 112, 114, 116, 118, 120, 122 and 124 themselves may be in well known forms, and so detailed explanations for their structures is omitted in the present specification.

Figure 2:
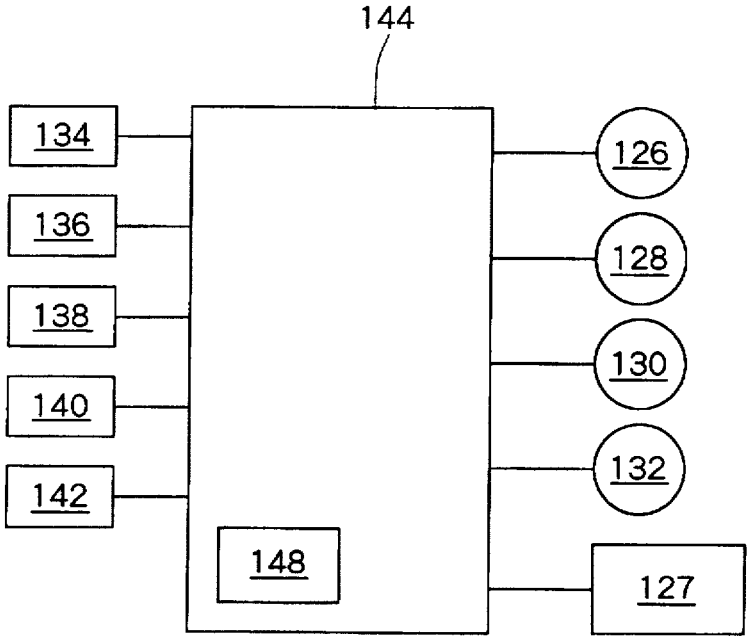
FIG. 2 is a block diagram schematically showing the constituent control elements that are disposed in the document feeder of FIG. 1.

Referring to FIG. 2 along with FIG. 1, in the document feed means of the illustrated embodiment, the document feed-out means 74 and the feed roller pairs 106 and 108 are connected with a common electric motor 126. Between the document feed-out means 74 as well as the feed roller pair 106 and the electric motor 126, an electromagnetic clutch 127 is interposed. The feed roller pair 110 and the feed belt mechanism 92 are connected to a common electric motor 128, the feed roller pairs 112, 114 and 124 are connected to a common electric motor 130, and the feed roller pairs 116, 118, 120 and 122 are connected to a common electric motor 132. With reference to FIGS. 1 and 2, a document detector 134 is disposed at the upstream end of the first switchback path 26 (i.e., the upstream side of the feed roller pair 108), a document detector 136 is disposed at the downstream end of the send-in path 28 (i.e., the downstream side of the feed roller pair 110), a document detector 138 is disposed at the upstream end of the second switchback path 32 (i.e., the upstream side of the feed roller pair 112), a document detector 140 is disposed at an intermediate portion of the return path 34 (i.e., the upstream side of the feed roller pair 124), and a document detector 142 is disposed at the upstream end of the common path 38 (i.e., the upstream side of the feed roller pair 116). These document detectors 134, 136, 138, 140 and 142 may be composed of suitable sensors such as reflection type photosensors. On the document support plate 10, moreover, a plurality of detectors (not shown) for detecting the widthwise position of the movable regulating member 20 are disposed with a suitable spacing in the width direction. In the illustrated embodiment, documents of the JIS paper size B5, A4, B4 or A3 are placed on the document support plate 10 in a so-called lateral orientation, namely, with the longitudinal direction of each document being consistent with the widthwise direction of the document support plate 10 (the direction perpendicular to the sheet face in FIG. 1). Thus, the size of the document can be recognized by detecting the position of the movable regulating member 20 to detect the length of the document in a direction normal to the direction of document feeding. If the detection of the length of the document in the direction of its feeding is also necessary to recognize the size of the document, it is recommendable, for example, to detect a period of time taken until the document detector 134 detects the rear end of the document after it detects the front end of the document (detection of such time can be done by a timer means contained in a control means 144 which may be composed of a microprocessor).

Next, the manner of document feeding by the foregoing document feeder 6 will be described. First, an explanation is offered for the scan exposure or scan reading of only one side of each of a plurality of documents. The plural documents are stacked in a required order (i.e. in the sequence of pages), and this document stack is placed on the document support plate 10 of the document support means 8, with that one side of each document facing down. At this time, the front end of the document stack is in contact with or approaches to the regulating member 16 located at the lowered position, and the rear edge of the document stack is in contact with or approaches the stationary regulating member (not shown) of the width regulating means 18. The movable regulating member 20 of the width regulating means 18 is moved in the width direction to contact or approach the front edge of the document stack, while the regulating member of the rear end regulating means 22 is moved in the direction of feeding (in the left-to-right direction in FIG. 1) to contact or approach the rear end of the document stack. Upon movement of the movable regulating member 20 of the width regulating means 18 to the required position in correspondence with the width of the document stack, the widthwise position of the movable regulating member 20 can be detected in the above-described manner, thereby detecting which of the JIS paper sizes B5, A4, B4 and A3 the documents are.

Figure 3:
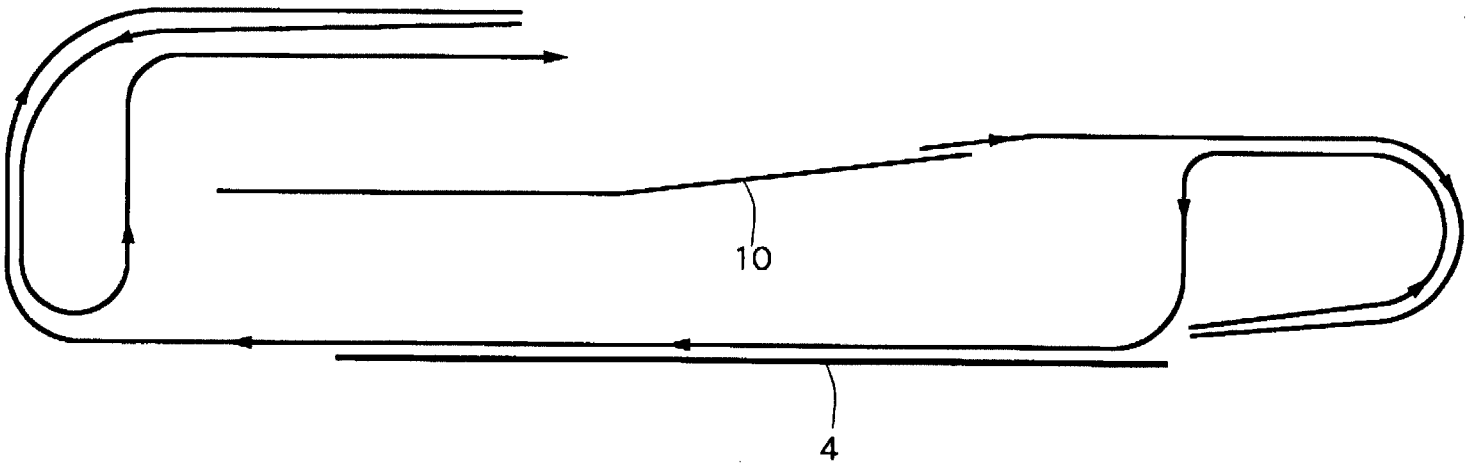
FIG. 3 is a simplified diagram schematically showing the manner of document feeding in the document feeder of FIG. 1 when scan exposing or scan reading only one side of the document.
Figure 5:
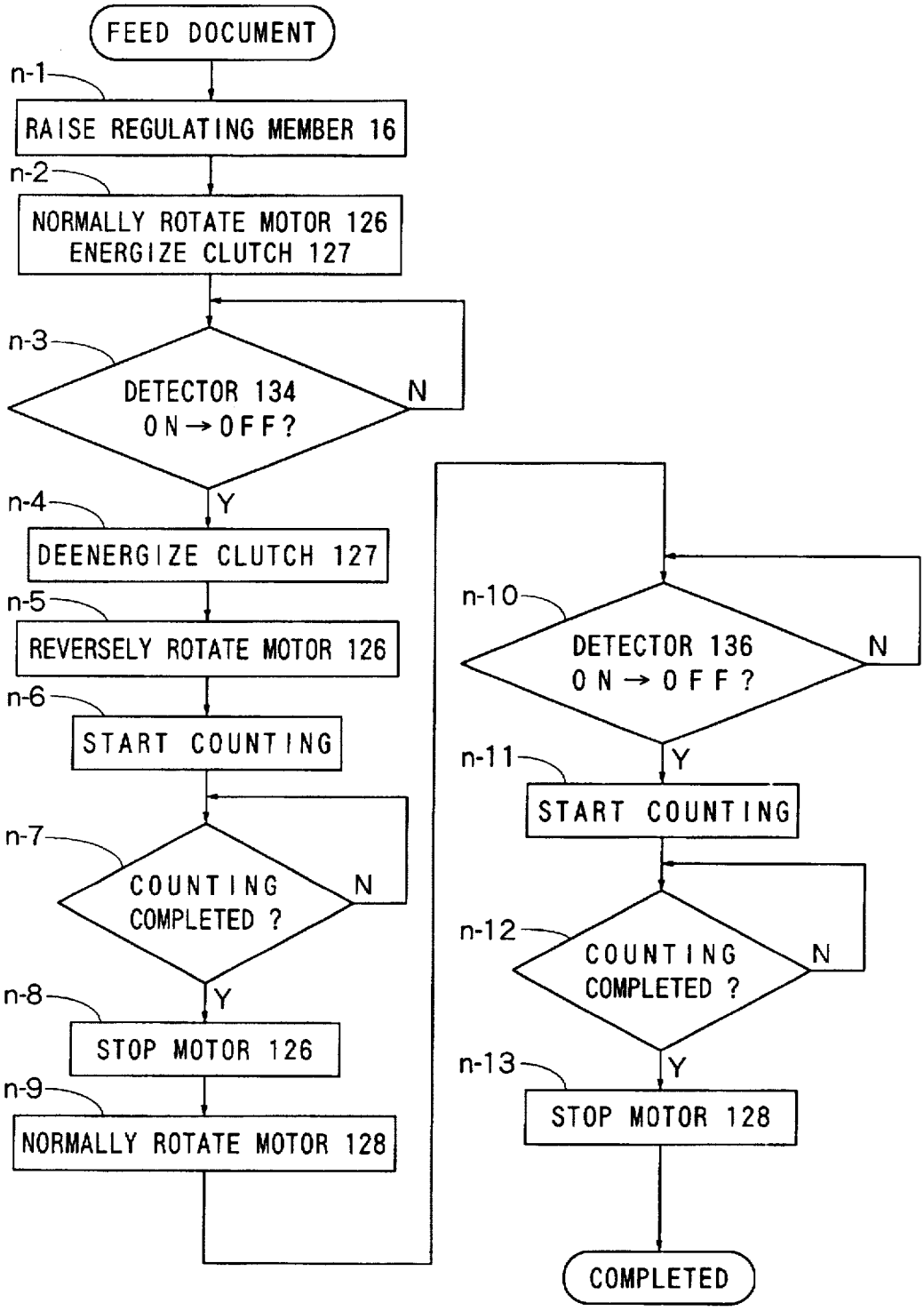
FIG. 5 is a flow chart showing a step of sending in the document in the document feeder of FIG. 1 when scan exposing or scan reading only one side of the document.

When the placement of the document stack in the above manner is completed, an operation start switch disposed on an operating panel (not shown) of the image forming machine (or an operating panel of the document feeder 6 itself) is actuated to start document feeding. With reference to FIGS. 3 and 5 along with FIGS. 1 and 2, a document feed step as illustrated in FIG. 5 is started by actuating the operation start switch. At step n-1, the regulating member 16 of the front end regulating means 12 is brought to the raised position, making it possible to feed out the bottom-most document of the document stack. The separating member (not shown) disposed on the stationary regulating member and movable regulating member 20 of the width regulating means 18 is caused to protrude over the document stack. The suction source (not shown) to which the multiple openings formed in the endless belt 84 are communicated is energized, thus the bottom-most document of the document stack is sucked by the endless belt 84. The blower (not shown) is energized to jet air toward the front end of the document stack from the air jet path 88. Then, at step n-2, normal rotation of the electric motor 126 is started. Simultaneously, the electromagnetic clutch 127, interposed between the electric motor 126 and the document feed-out means 74 as well as the feed roller pair 106, is energized to establish driving connection of the electric motor 126, the document feed-out means 74, and the feed roller pair 106. Thus, the document feed-out means 74, the feed roller pair 106, and the feed roller pair 108 are normally rotated in the direction of arrows 86. As a result, the bottom-most document is moved from the document stack on the document support means 8 in the direction of arrows 86, and fed into the first switchback path 26 through the feed-out path 24. At step n-3, it is determined whether or not the document detector 134, which has once become ON by the passage of the front end of the document, has returned to an OFF state upon the passage of the rear end of the document through the document detector 134. When the document detector 134 has returned to OFF, the procedure goes to step n-4 where the electromagnetic clutch 127 is deenergized to release the document feed-out means 74 from the electric motor 126. Hence, rotation of the document feed-out means 74 and the feed roller pair 106 are stopped. Then, at step n-5, the reverse rotation of the electric motor 126 is started to rotate the feed roller pair 108 in the direction of an arrow 146. Consequently, the direction of feeding of the document fed into the first switchback path 26 is reversed to feed the document from the first switchback path 26 to the send-in path 28. Then, step n-6 is effected so that a counter means 148, incorporated in the control means 144, starts counting. At step n-7, when the counter means 148 counts up to a predetermined number, the procedure proceeds to step n-8 to stop the reverse rotation of the electric motor 126. Then, at step n-9, the electric motor 128 is normally rotated to rotationally drive the feed roller pair 110 and the feed belt mechanism 92 in the direction of their arrows 86. Before the counter means 148 counts up to the predetermined number and the rotational driving of the feed roller pair 110 and the feed belt mechanism 92 begins, the front end of the document fed to the send-in path 28 arrives at the nip of the feed roller pair 110 which is at a standstill, whereupon the front end of the document is brought into contact with the nip. Because of this, if the document is somewhat inclined, this inclination is corrected. Then, the rotational driving of the feed roller pair 110 and the feed belt mechanism 92 is begun, to introduce the document onto the transparent platen 4 through the send-in path 28. When the normal rotation of the electric motor 128 is started at step n-9, if the rear end portion of the document exists through the feed roller pair 108 and the document detector 134 is ON, the reverse rotation of the electric motor 126 is also started simultaneously, and when the document detector 134 has returned to OFF by the passage of the rear end of the document, the reverse rotation of the electric motor 126 is stopped. At step n-10, it is determined whether or not the document detector 136, which has once become ON by the passage of the front end of the document, has returned to an OFF state upon the passage of the rear end of the document through the document detector 136. When the document detector 136 has returned to OFF, the procedure goes to step n-11 where the counter means 148 starts counting. At step n-12, when the counter means 148 counts up to a predetermined number, the procedure proceeds to step n-13 to stop the normal rotation of the electric motor 128. The predetermined number that the counter means 148 counts at step n-11 is determined by the length of the document in the direction of feeding. At the time when the normal rotation of the electric motor 128 is stopped and the rotational driving of the feed roller pair 110 and the feed belt mechanism 92 is stopped, the document is located on the required position on the transparent platen 4.

When the document is located at the required position on the transparent platen 4, with the aforementioned one side thereof facing down, that one side of the document is scan exposed or scan read, for example, by scan moving a scanning optical system in the image forming machine 2. Upon completion of the scan exposure or scan reading, signals are supplied from the image forming machine 2 to the control means 144 of the document feeder 6. As a result, a document send-out step for expelling the document from the transparent platen 4 and returning it to the document support means 8 is started in the document feeder 6. Also, a document send-in step for conveying the next document onto the transparent platen 4 is started. For example, the next document may be fed in the following manner: When the preceding document is to be conveyed onto the transparent platen 4 past the first switchback path 26 and the send-in path 28, the rear edge of the preceding document passes the document detector 134, so that the document detector 134 returns from ON state to OFF state. At this time, feeding of the next document (the bottom-most document remaining in the document stack positioned on the document support plate 10) is started. By the time the scan exposure or scan reading of that one side of the preceding document is completed, the next document is conveyed to a position at which the front edge of the next document contacts the nip of the feed roller pair 110 which is at a standstill.

Figure 6:
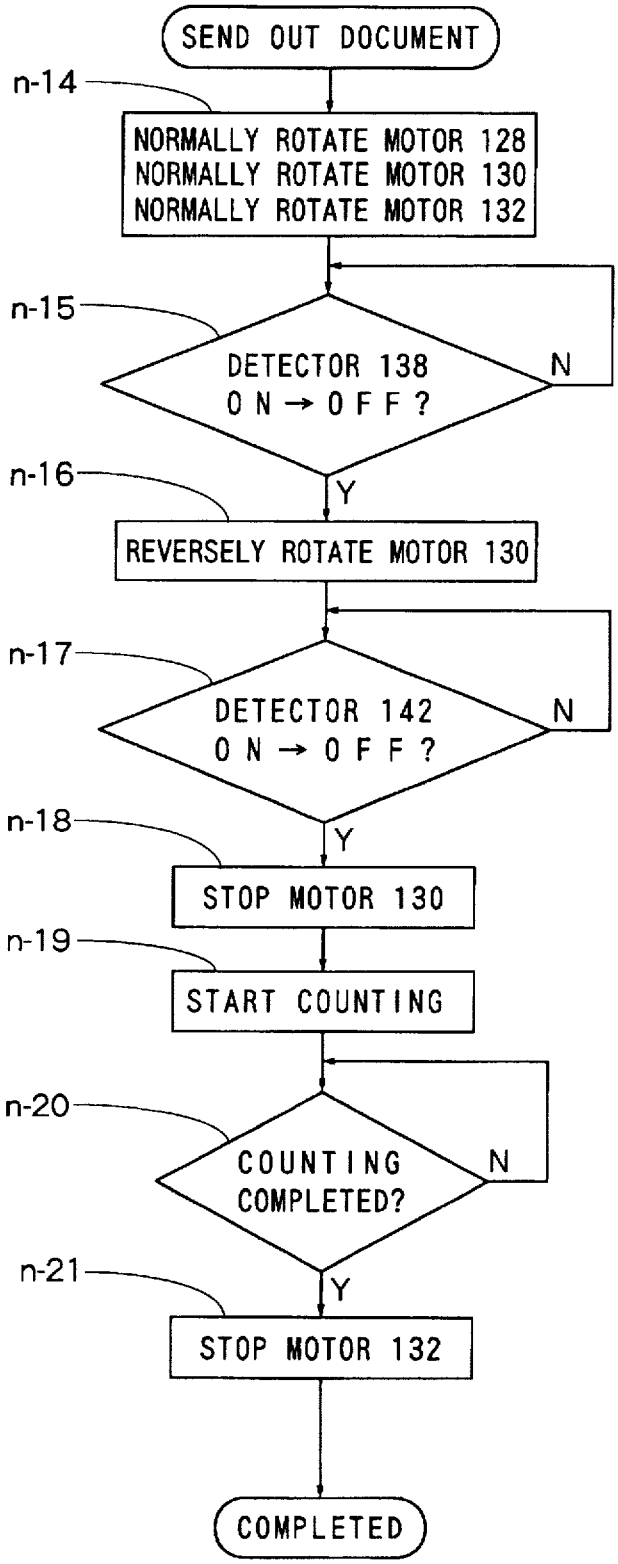
FIG. 6 is a flow chart showing a step of sending out the document in the document feeder of FIG. 1 when scan exposing or scan reading only one side of the document.

With reference to FIG. 6 together with FIGS. 1 to 3, a step of sending out documents following scan exposure or scan reading of one side is described. At step n-14, the normal rotation of the electric motors 128, 130 and 132 is started, whereby the feed belt mechanism 92 (and the feed roller pair 110) and the feed roller pairs 112, 114, 124, 116, 118, 120 and 122 are rotationally driven in the direction of their arrows 86. Thus, the document on the transparent platen 4 is fed into the second switchback path 32 through the send-out path 30. At step n-15, it is determined whether or not the document detector 138, which has once become ON by the passage of the front end of the document, has returned to an OFF state upon the passage of the rear end of the document through the document detector 138. When the document detector 138 has returned to OFF, the procedure goes to step n-16 to switch the electric motor 130 from normal rotation to reverse rotation. As a result, the feed roller pairs 112, 114 and 124 are rotationally driven in the direction of their arrows 146. Thus, the direction of feeding of the document fed to the second switchback path 32 is reversed, whereupon the document is conveyed from the second switchback path 32 to the return path 34. After passing the return path 34, the document is returned to the document support means 8. When the document is of the JIS B5 size, the switching members 62, 64 and 66 disposed at the downstream portion of the return path 34, i.e., the common path 38, are all located at the nonoperating positions shown by solid lines. Thus, the document is conveyed to the downstream end of the common path 38, and returned onto the document stack present on the document support plate 10, with the aforementioned one side of the document facing down. When the document is of the JIS A4 size, the switching members 62 and 64 are located at the nonoperating positions shown by the solid lines. Whereas the switching member 66 is located at the operating position shown by a two-dot chain line. Thus, the document is moved downwardly from the upstream side of the switching member 66, and returned onto the document stack present on the document support plate 10, with the aforementioned one side of the document facing down. When the document is of the JIS B4 size, the switching members 62 and 66 are located at the nonoperating positions shown by the solid lines. Whereas the switching member 64 is located at the operating position shown by the two-dot chain line. Thus, the document is moved downwardly from the upstream side of the switching member 64, and returned onto the document stack present on the document support plate 10, with the aforementioned one side of the document facing down. When the document is of the JIS A3 size, the switching members 64 and 66 are located at the nonoperating positions shown by the solid lines. Whereas the switching member 62 is located at the operating position shown by the two-dot chain line. Thus, the document is moved downwardly from the upstream side of the switching member 62, and returned onto the document stack present on the document support plate 10, with the aforementioned one side of the document facing down. At step n-17, it is determined whether or not the document detector 142, which has once become ON by the passage of the front end of the document, has returned to an OFF state upon the passage of the rear end of the document through the document detector 142. When the document detector 142 has returned to OFF, the reverse rotation of the electric motor 130 is stopped at step n-18. At step n-19, the counter means 148 starts counting. At step n-20, when the counter means 148 counts up to a predetermined number, the procedure proceeds to step n-21 to stop the normal rotation of the electric motor 132. The predetermined number that the counter means 148 counts at step n-20 is determined suitably by the length of the document in the direction of feeding. The electric motor 128 whose normal rotation was started at step n-14 is stopped at the aforementioned step n-13 related to the next document. (If the next document to be fed does not exist, the electric motor 128 may be stopped at the above step n-16.)

The foregoing document send-in step and document send-out step are performed for each of the plurality of documents. If it is desired to carry out a plurality of scan exposures and scan readings for each of the plurality of documents, the above-mentioned document send-in and send-out steps may be performed in succession.

Figure 4:
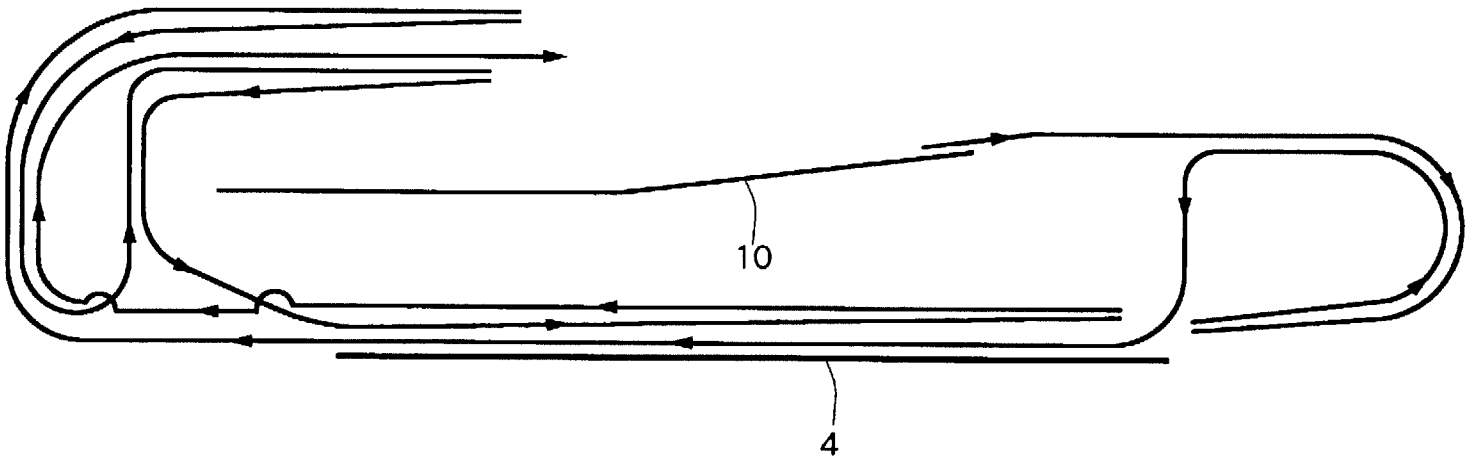
FIG. 4 is a simplified diagram schematically showing the manner of document feeding in the document feeder of FIG. 1 when scan exposing or scan reading both sides of the document.
Figure 7:
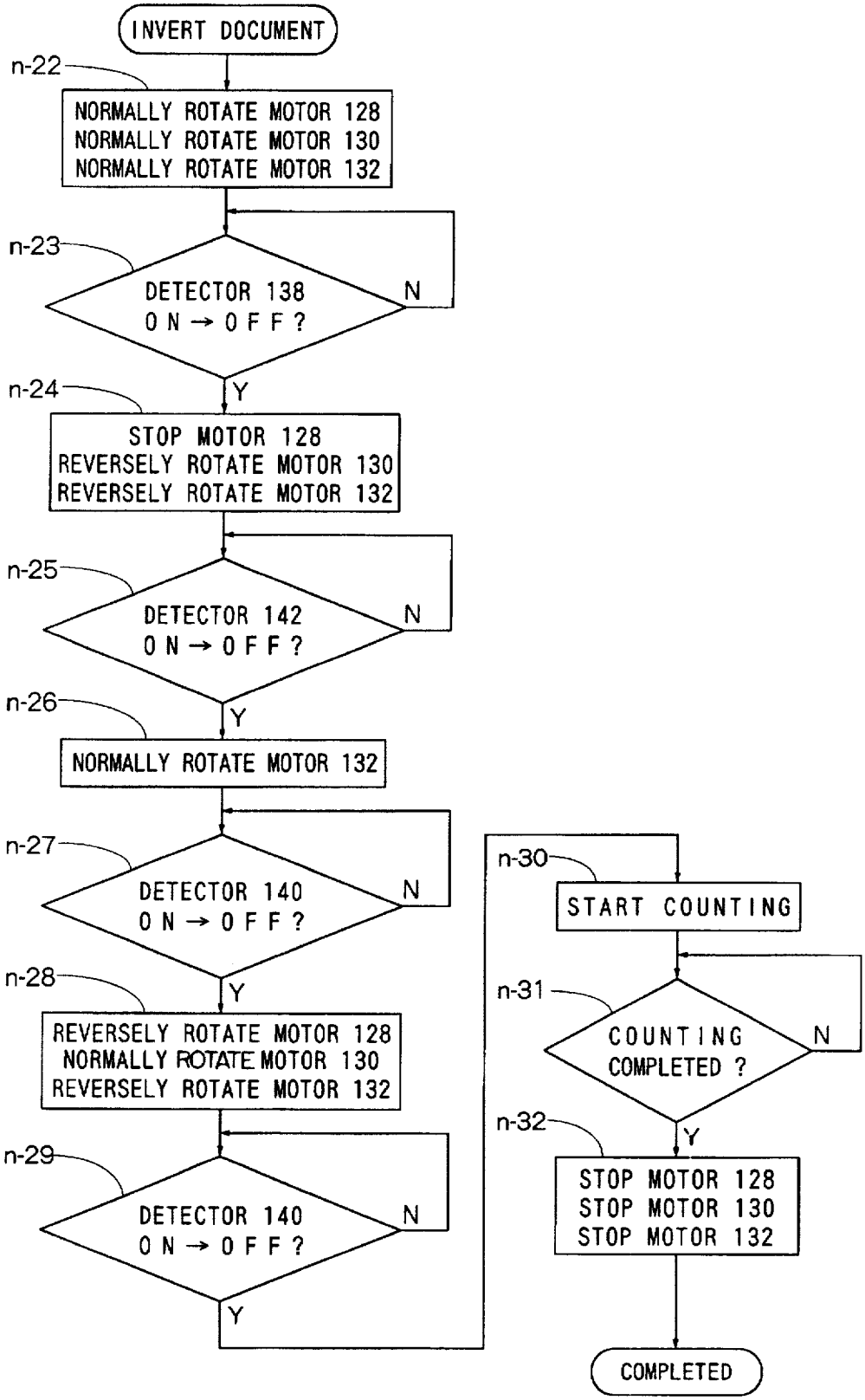
FIG. 7 is a flow chart showing a step of inverting the document in the document feeder of FIG. 1 when scan exposing or scan reading both sides of the document.

Next, an explanation is offered for scan exposure or scan reading of both sides of each of the plurality of documents. In this case as well, as with scan exposure or scan reading of only one side of each document, the plural documents are stacked in a required order (i.e. in the sequence of pages). This document stack is placed on the document support plate 10 of the document support means 8, with the selected one side (face) of each document facing down. Then, the document send-in step as described with reference to FIG. 5 is performed. After the document has been fed to the required position on the transparent platen 4, with the aforementioned one side thereof facing down, that one side of the document is scan exposed or scan read in the image forming machine 2. Upon completion of the scan exposure or scan reading, signals are supplied from the image forming machine 2 to the control means 144 of the document feeder 6, whereupon a document inversion step is started. With reference to FIGS. 4 and 7 together with FIGS. 1 and 2, at step n-22, the normal rotation of the electric motors 128, 130 and 132 is started, whereby the feed belt mechanism 92 (and the feed roller pair 110) and the feed roller pairs 112, 114, 124, 116, 118, 120 and 122 are rotationally driven in the direction of their arrows 86. Thus, the document on the transparent platen 4 is fed into the second switchback path 32 through the send-out path 30. At step n-23, it is determined whether or not the document detector 138, which has once become ON by the passage of the front end of the document, has returned to an OFF state upon the passage of the rear end of the document through the document detector 138. When the document detector 138 has returned to OFF, the procedure goes to step n-24 to stop the electric motor 128 and switch the electric motors 130 and 132 from normal rotation to reverse rotation. As a result, the feed belt mechanism 92 (and the feed roller pair 110) is stopped, the feed roller pairs 112, 114 and 124 are rotationally driven in the direction of their arrows 146, and the feed roller pairs 116, 118, 120 and 122 are rotationally driven in the direction of their arrows 146. Thus, the direction of feeding of the document fed to the second switchback path 32 is reversed, whereupon the document is conveyed from the second switchback path 32 to the return path 34. Then, at step n-25, it is determined whether or not the document detector 142, once rendered ON by the passage of the front edge of the document fed to the second switchback path 32, has returned to OFF because the direction of feeding of the document is reversed. (In the illustrated embodiment, the minimum length of the document in the direction of feeding is greater than the distance between the document detector 138 and the document detector 142.) When the document detector 142 has returned to OFF, the procedure goes to step n-26 to return the electric motor 132 from reverse rotation to normal rotation. Thus, the feed roller pairs 116, 118 and 120 are rotationally driven in the direction of their arrows 86. Then, at step n-27, it is determined whether or not the document detector 140, which has once become ON by the passage of the front end of the document, has returned to an OFF state upon the passage of the rear end of the document through the document detector 140. When the document detector 140 has returned to OFF, the procedure goes to step n-28 to start the reverse rotation of the electric motor 128, switch the electric motor 130 from reverse rotation to normal rotation, and switch the electric motor 132 from normal rotation to reverse rotation. As a result, the feed belt mechanism 92 (and the feed roller pair 110) is rotationally driven in the direction of its arrow 146, the feed roller pair 124 (and the feed roller pairs 112 and 114) is rotationally driven in the direction of its arrow 86, and the feed roller pairs 116, 118, 120 and 122 are rotationally driven in the direction of their arrows 146. Thus, the document fed through the intermediate portion to the downstream portion of the return path 34 is fed from the return path 34 to the resend-in path 36 upon reversal of the direction of feeding. Past the resend-in path 36, the document is resent onto the transparent platen 4. The document resent onto the transparent platen 4 from the other end of the transparent platen 4 (the left end in FIG. 1) has its face and back inverted; that is, the other side (back) of the document faces downwardly. At step n-29, it is determined whether or not the document detector 140, which has once become ON by the passage of the front end of the document, has returned to an OFF state upon the passage of the rear end of the document through the document detector 140. When the document detector 140 has returned to OFF, the procedure goes to step n-30, where the counter means 148 starts counting. At step n-31, when the counter means 148 counts up to a predetermined number, the procedure proceeds to step n-32 to stop the rotation of the electric motors 128, 130 and 132. The predetermined number that the counter means 148 counts at step n-31 is set according to the length of the document in the direction of feeding. When the rotation of the electric motors 128, 130 and 132 comes to a halt, the document is located at a predetermined position on the transparent platen 4.

When the document is located at the required position on the transparent platen 4, with the aforementioned other side thereof facing down, that other side of the document is scan exposed or scan read, for example, by scan moving a scanning optical system in the image forming machine 2. Upon completion of the scan exposure or scan reading, signals are supplied from the image forming machine 2 to the control means 144 of the document feeder 6. Thus, a document send-out step for expelling the document from the transparent platen 4 and returning it to the document support means 8 is started in the document feeder 6. Also, a document send-in step for conveying the next document onto the transparent platen 4 is started. The next document may be fed, for instance, in the following manner: At a suitable time point during the aforementioned face-back inversion step for the preceding document, the feeding of the next document is started. By the time when the scan exposure or scan reading of that other side of the preceding document is completed, the next document is conveyed to a position at which the front edge of the next document contacts the nip of the feed roller pair 110 which is at a standstill.

Figure 8:
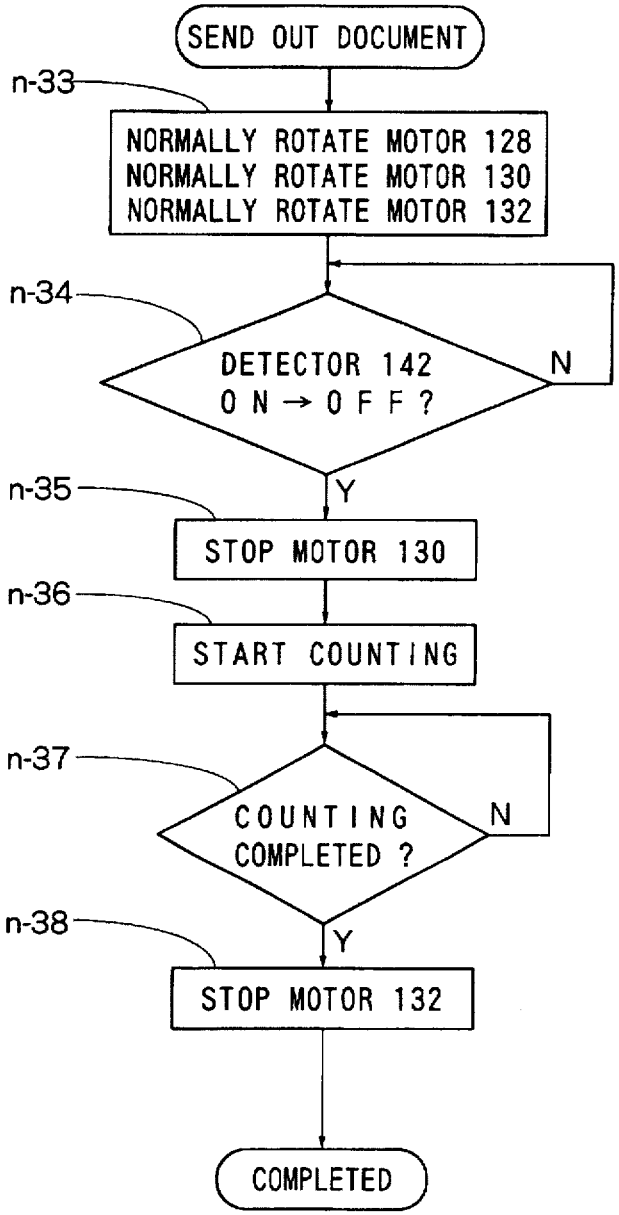
FIG. 8 is a flow chart showing a step of sending out the document in the document feeder of FIG. 1 when scan exposing or scan reading both sides of the document.

With reference to FIG. 8 together with FIGS. 1 to 3, a step of sending out documents following scan reading of both sides is described. At step n-33, the normal rotation of the electric motors 128, 130 and 132 is started, whereby the feed belt mechanism 92 (and the feed roller pair 110) and the feed roller pairs 112, 114, 124, 116, 118, 120 and 122 are rotationally driven in the direction of arrow 86. Thus, the document is returned to the document support means 8 through the second switchback path 32. When, in this case as well, the document is of the JIS B5 size, the switching members 62, 64 and 66 disposed at the downstream portion of the return path 34, i.e., the common path 38, are all located at the nonoperating positions shown by the solid lines. Thus, the document is conveyed to the downstream end of the common path 38, and returned onto the document stack present on the document support plate 10, with the aforementioned one side of the document facing down. When the document is of the JIS A4 size, the switching members 62 and 64 are located at the nonoperating positions shown by the solid lines, whereas the switching member 66 is located at the operating position shown by the two-dot chain line. Thus, the document is moved downwardly from the upstream side of the switching member 66, and returned onto the document stack present on the document support plate 10, with the aforementioned one side of the document facing down. When the document is of the JIS B4 size, the switching members 62 and 66 are located at the nonoperating positions shown by the solid lines, whereas the switching member 64 is located at the operating position shown by the two-dot chain line. Thus, the document is moved downwardly from the upstream side of the switching member 64, and returned onto the document stack present on the document support plate 10, with the aforementioned one side of the document facing down. When the document is of the JIS A3 size, the switching members 64 and 66 are located at the nonoperating positions shown by the solid lines, whereas the switching member 62 is located at the operating position shown by the two-dot chain line. Thus, the document is moved downwardly from the upstream side of the switching member 62, and returned onto the document stack present on the document support plate 10, with the aforementioned one side of the document facing down. At step n-34, it is determined whether or not the document detector 142, which has once become ON by the passage of the front end of the document, has returned to an OFF state upon the passage of the rear end of the document through the document detector 142. When the document detector 142 has returned to OFF, the normal rotation of the electric motor 130 is stopped at step n-35. At step n-36, the counter means 148 starts counting. At step n-37, when the counter means 148 counts up to a predetermined number, the procedure proceeds to step n-38 to stop the normal rotation of the electric motor 132. The predetermined number that the counter means 148 counts at step n-37 is set suitably according to the length of the document in the direction of feeding. The electric motor 128 whose normal rotation was started at step n-33 is stopped at the aforementioned step n-13 related to the next document. (If the next document to be fed does not exist, the electric motor 128 may be stopped at the above step n-35.)

The foregoing document send-in step, document inversion step, and document send-out step are performed for each of the plurality of documents. If it is desired to carry out a plurality of scan exposures or scan readings for each of the plurality of documents, the above-mentioned document send-in, document inversion and document send-out steps may be performed in succession.

While some preferred embodiments of the present invention have been described in detail with reference to the accompanying drawings, it is to be understood that the invention is in no way limited thereto, but various changes and modifications may be made without departing from the spirit and scope of the invention.

What we claim is:

1. A recirculating document feeder for use with an image forming machine having a transparent platen, said feeder comprising:

document support means disposed above the transparent platen and adapted to have a stack of documents placed thereon with a selected side of each document facing down;

means defining a feed-out path extending from a first end of said document support means;

means defining a first switchback path having an upstream end connected to the downstream end of said feed-out path;

means defining a send-in path extending from an upstream end thereof, connected to the upstream end of said first switchback path, to a first end of said transparent platen;

means defining a send-out path extending from a second end of said transparent platen;

means defining a second switchback path having an upstream end connected to the downstream end of said send-out path;

means defining a return path extending from an upstream end thereof, connected to the upstream end of said second switchback path, to a second end of said document support means, a downstream portion of said second switchback path and a downstream portion of said return path being merged;

means defining a resend-in path extending between an intermediate portion of said return path and the second end of said transparent plate; and document feed means for feeding the bottom-most document of said document stack from said document support means out to said feed-out path, feeding this document to said first switchback path through said feed-out path, and then reversing the direction of feeding of the document to send the document onto said transparent platen through said send-in path; and for then selectively (a) feeding the document from said transparent platen to said second switchback path through said send-out path, and then again reversing the direction of feeding of the document to return the document onto the document stack on said document support means through said return path, or (b) feeding the document from said transparent platen to said second switchback path through said send-out path, then again reversing the direction of feeding of the document to feed the document to a downstream portion of said return path, then further reversing the direction of feeding of the document to resend the document onto said transparent platen through said resend-in path, and once again reversing the direction of feeding of the document to return the document from said transparent platen onto said document stack on said document support means through said second switchback path.

* * * * *